US006098904A

United States Patent [19]

Davidson et al.

[11] Patent Number: 6,098,904

[45] Date of Patent: Aug. 8, 2000

[54] NOZZLE FOR PRODUCING A HIGH-IMPACT LONG-RANGE JET FROM FAN-BLOWN AIR

[75] Inventors: Kirk John William Davidson; John Frederick Hayden Davidson, both of Waterloo, Canada

[73] Assignee: Air Force 1 Blow Off Systems Inc., Waterloo, Canada

[21] Appl. No.: 09/272,745

[22] Filed: Mar. 10, 1999

[30] Foreign Application Priority Data

Mar. 10, 1998 [CA] Canada ..... 2231602

[51] Int. Cl.[7] ..... B05B 1/00

[52] U.S. Cl. ..... 239/590; 239/589; 239/DIG. 21

[58] Field of Search ..... 239/589, 590, 239/DIG. 3, DIG. 7, DIG. 11, DIG. 21; 118/62, 63

[56] References Cited

U.S. PATENT DOCUMENTS

| | | | |
|---|---|---|---|
| 1,902,202 | 3/1933 | Vawter | 239/590 |
| 3,794,137 | 2/1974 | Teodorescu et al. | 239/DIG. 7 X |
| 4,622,714 | 11/1986 | Tomasello | 239/589 X |
| 5,596,818 | 1/1997 | Jones | 34/666 |
| 5,636,795 | 6/1997 | Sedgwick | 239/406 |
| 5,822,878 | 10/1998 | Jones | 34/585 |

*Primary Examiner*—Lesley D. Morris
*Attorney, Agent, or Firm*—Anthony Asquith & Co.

[57] ABSTRACT

Blow-off nozzles are used for creating a high-energy air blast, for drying metal panels prior to painting. Depth or reach of penetration (in the atmosphere) is important. A bullet is provided in the center of the nozzle. The bullet is aerodynamically faired, for minimum drag. The effect of the bullet is to create a low pressure area in the jet downstream of the nozzle. The low pressure area serves to hold the jet together, preventing spreading, to a degree that enables a significant increase in penetration distance. The bullet is mounted on faired arms, which are secured to the walls of the nozzle.

18 Claims, 6 Drawing Sheets

23
24
25
26
27
28
29
30
32
33
34
36
37

26
29
30
32

40

RECTANGULAR TAPERED PLENUM
ONE 6" INLET AND SIX 6" OUTETS
FIG 12c
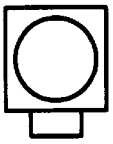
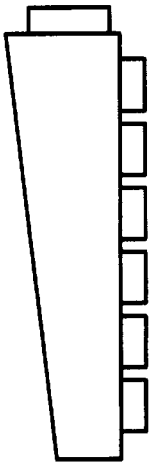
FIG 12a
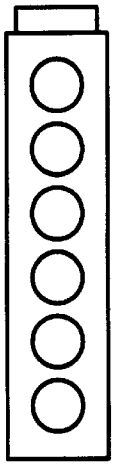
FIG 12b
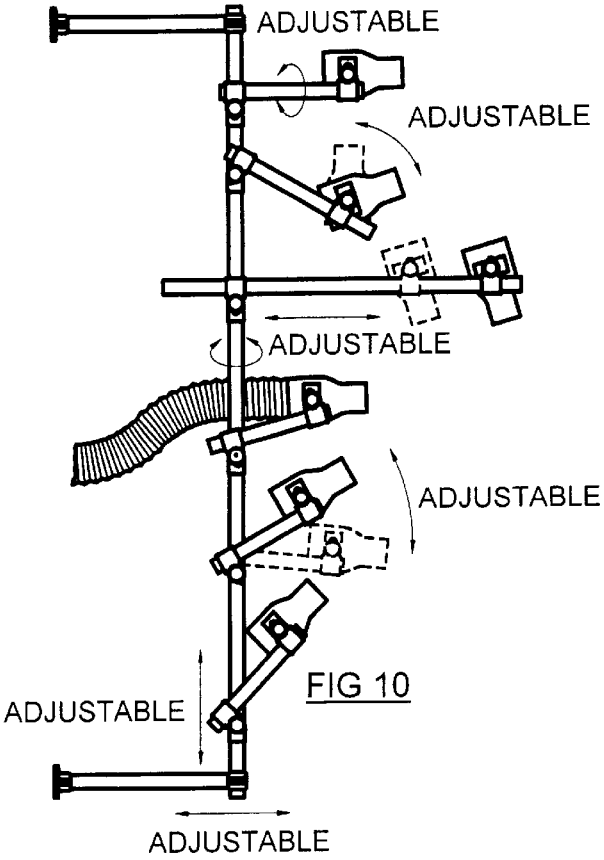
FIG 10
FIG 11a
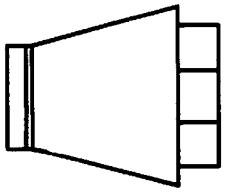
FIG 11b
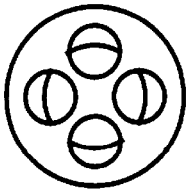
CIRCULAR TAPERED PLENUM
ONE 8" INLET AND FOUR 4" OUTLETS

NOZZLE FOR PRODUCING A HIGH-IMPACT LONG-RANGE JET FROM FAN-BLOWN AIR

This invention relates to apparatus for producing an intense jet of air from a nozzle. The jet of air is used industrially for such purposes as blowing water, dust, particulate material, etc, from surfaces, to clean and dry the surfaces preparatory to painting, application of adhesives, etc.

BACKGROUND TO THE INVENTION

Conventionally, in automotive component painting applications, for example, blow-off stations are provided between the workpiece washing station and the paint spray booth. The blow-off station includes several air-nozzles, which are fed from a common fan, driven by an electric motor. Typically, the fan supplies air at a flow rate of 2000 cfm or so, split between the several nozzles, and at a pressure of around 1 psi (27" water gauge). The air travels through flexible hoses or pipes to the nozzles, the hoses being, typically, four inches in diameter. The nozzles are mounted on a frame, and are adjustable as to mounting position and angle.

It is of course always possible to produce a vigorous enough flow of air by brute force, i.e by providing a large enough fan and motor. The present invention is aimed at providing a manner of designing the nozzle that enables the jet or stream of air emanating from the nozzle to penetrate further, downstream of the nozzle, for higher surface impact on the workpiece, without incurring a penalty of increased energy requirements.

THE PRIOR ART

It should be noted that the type of blowing-off to which the invention refers is done by air at low pressures. That is to say, the air-flow is generated by means of an air-fan, rather than by means of a positive displacement air-compressor.

It is of course possible to produce a vigorous jet of air by blowing high pressure air (e.g air from a factory air compressor, at 80 psi or so) out of a nozzle. However, it would be highly uneconomical to create the required huge flow rate needed for air blow-off systems using air at 80 psi.

On the other hand, air at 80 psi is widely available as a utility in factories generally, and there are a number of prior art technologies aimed at entraining atmospheric air into a high pressure (80 psi) jet, to allow some of the energy of the high pressure jet to be transferred to the surrounding air, to give the jet the desired volumetric flow rate. However, such systems are inherently very inefficient, and are only economical at all because the high pressure air supply already exists in the factory.

Industrial purpose-designed air blow-off systems use a fan that provides the air at low pressures, i.e at pressures in the 0.5 to 2 psi region. In this case, the designer tries to avoid entraining air from the atmosphere into the jet. The invention is concerned with applying as much as possible of the energy derived from the fan into enabling the jet to penetrate more deeply through the atmosphere, and such entrainment would, in the present case, serve simply to dissipate the energy of the jet, and detract from penetration.

Patent publication U.S. Pat. No. 5,636,795 (Sedgwick, June 1997) shows an air-jet-projecting apparatus, of the type with which the invention is generally concerned, in which a liquid-spray head is positioned co-axially within the nozzle.

Patent publication U.S. Pat. No. 5,822,878 (Jones, October 1998) shows another air-jet projecting apparatus, in which an ovoid (i.e football-shaped) member is located within the nozzle.

THE INVENTION IN RELATION TO THE PRIOR ART

The invention provides a bullet, which is mounted in position in the centre of the nozzle. The bullet serves, in operation, to create a reduced-pressure region downstream of the nozzle.

It has been found that the reduced-pressure region can be made to extend so far downstream of the nozzle, under the conditions as described herein, as to suck the jet in somewhat, and to hold the jet together. The main reason why air jets fail to penetrate a large distance is that the jet tends to spread or widen, to strike the atmospheric air, and thereby to dissipate its energy. The reduced-pressure region created by the bullet sucks the jet in, and keeps the jet together, for a significantly increased distance. Thus, for example, where a traditional low-pressure air nozzle might enable air to penetrate a maximum of perhaps four feet, a similar nozzle with the bullet can enable air to penetrate five or even six feet.

Of course, it is always possible to create whatever strength of jet is desired, simply by using a larger power source to pump more air through a nozzle at higher pressure. But the concern in this present case is with the efficiency at which a given strength of jet can be provided. A high pressure jet (as from a conventional positive-displacement factory air compressor) creates such a high velocity in the emerging air as to create an aura around the jet, which tends to suck in outside air and entrain it in the jet. Thereby, the jet can impart a portion of its energy to the surrounding air. With this entrainment, instead of all the energy of the jet being in the form of high-speed/low-mass, the energy of the jet now becomes medium-speed/medium-mass, which is more useful for doing work. But still, a high-pressure system is inefficient; as a general principle, it is inefficient to create high pressure, then destroy it.

In the Sedgwick patent mentioned above, the emerging jet is given a vigorous spin or rotational velocity. It might be considered that a reduced-pressure region exists on the inside of the emerging jet, because of the cyclone effect arising from the spin. However, it should be noted that a cyclone creates a spinning vortex, with a low pressure area inside, because of the presence of the low pressure; i.e in a cyclone the low pressure core creates the spin, the spin does not create the low pressure core. In Sedgwick, the spin velocity has to be generated by the jet itself, and that takes energy. Also, whatever spin velocity exists will be at its maximum at the outside of the stream, where the stream hits the stationary air. This interaction creates more friction, and wastes more energy. In fact, in Sedgwick, whatever energy goes into creating the rotation of the cyclone, must take away from the energy available for the forwards penetration of the jet.

It is an aim of the present invention that the bullet should create the downstream reduced-pressure region aerodynamically, and thereby cause only a minimum of disruption to the jet, whereby downstream longitudinal penetration of the jet can be achieved with a minimum of wasted energy.

The Jones patent shows a football-shaped insert within the nozzle. However, in Jones, the insert is located in a place where the velocity of the air is relatively slow. In the present invention, the insert, or bullet, is located where the velocity of the air is at a maximum, and where the effectiveness of the bullet in creating a downstream pressure reduction is highest.

In the invention, the nozzle unit includes a convergence transition, which entails a convergence of the area of the nozzle preferably to about 50%. In the invention, the nozzle has a convergence-transition down from the supply pipe diameter to a much-narrower right-cylindrical nose on the front end of the nozzle. In the invention, the bullet is located axially within the narrow nose.

It may be noted that, in the Jones patent, the nozzle depicted therein basically does not have a transition convergence, although the nozzle does have a conical nose. In the invention, the nozzle has a significant transition convergence (preferably to 50% on an area basis) and the nozzle also has a cylindrical nose, and the bullet is located within the nose. Thus, the difference lies in the shape of the nozzle and in the positioning of the bullet within the nozzle.

In any nozzle, air is accelerated up to exit speed by reducing the cross-sectional area through which the air passes. It might be considered, in the context of the invention, that keeping the outside diameter of the nozzle the same as the pipe, and making the bullet so large that the bullet nearly fills the nozzle, would be a way of creating the reduced area downstream, which, as explained, is necessary for focusing the air-stream. However, the overall or outside dimensions of the jet should be kept small. If the nozzle is large, and the bullet is large, so that the jet becomes a thin annulus, the area of the jet that is exposed to the outside air is correspondingly large, and so, even though the jet might emerge with good energy, the losses associated with the interaction would be also large. Therefore, the bullet should not be so large that the flow through the nozzle has a configuration that could be considered annular to a significant degree. The cross-sectional area of the bullet should not be too large, such that the jet would acquire an annular character. In that case, a large proportion of the total flow of the jet would be located near the outside diameter of the jet, which is the area where the energy of the jet is quickly dissipated by exposure to the atmosphere. In order for the jet to be concentrated, and focussed, to achieve long penetration into the atmosphere, the jet should be kept small as to its overall cross-sectional area. It is recognised that for this reason the area of the bullet should be no more than about 30 percent of the area of the nozzle in which it is mounted.

By the same token, the bullet should not be too small. The purpose of the bullet is to produce a significant reduced-pressure effect in the jet of air downstream of the nozzle. It can be argued that even a fine hair in the nozzle must, at least theoretically, produce some downstream effect, but in the context of the invention it is recognised that the desired reduced-pressure region is not present significantly or substantively unless the bullet has a cross-sectional area of at least 10 percent of the area of the nozzle.

It is recognised that a bullet having an area of about 25 percent of the nozzle area is a practical and effective compromise between too large and too small. However, it is recognised that smaller bullets, for example in the 15 percent range (on an area basis), can be effective.

Nozzles are provided in many types of machine. Placing a bullet in the centre of a nozzle would have a different effect in different types of machine. In the nozzle system as described herein, lowering the pressure inside the jet has the effect of sucking the jet together. By reaction, the reduced-pressure region creates a force on the bullet tending to draw the bullet downstream, with the jet of air. Looking at this in the context of a jet engine, for example, the purpose of the nozzle is to convert the energy of the emerging stream of air into thrust for the aircraft, which, it will be understood, is somewhat counter to the purpose of enabling the stream to penetrate as far as possible away from the nozzle.

The bullet should be aerodynamically faired. If the bullet in the nozzle is not faired, the turbulence it creates can have the unwanted effect of making the jet spread out. Only when the bullet is faired does the bullet have the effect of creating a reduced-pressure region downstream, without turbulence. When a structure is described as aerodynamically faired, that means the structure is adapted to produce a streamlined flow around itself, without turbulence. In this case, the bullet should be so shaped as to be capable of gently bringing the divided air stream back together, downstream of the bullet. When the bullet is aerodynamically faired, any velocities of the air at right angles to the airstream, as imparted to the airstream in passing over the bullet, are tiny. The designer's aim should be to produce no turbulence of the airstream as the airstream passes over the bullet.

The invention provides a manner of focussing a jet of air from a nozzle, by providing a bullet in the nozzle which creates a reduced-pressure region downstream of the nozzle, which acts to draw the jet together, and to inhibit the jet from dissipating outwards into the atmosphere. It might be considered that a jet could be focussed and concentrated for maximum downstream penetration, by funnelling the jet through a convergent conical nozzle. It might be considered that the molecules of air have a radially-inwards component of velocity upon emerging from the nozzle, because they were given such a component just before leaving the nozzle by the conical shape of the nozzle. However, trying to focus the jet downstream of the nozzle by a means that acts on the outside of the jet, is recognised as not effective. The conical jet creates too much disruption at the mouth of the nozzle, whereby the jet becomes turbulent (and loses its energy) even closer to the mouth of the nozzle. It is proposed that the invention works because it does not do what a conical nozzle would do, i.e impose an inwards component of velocity only while the air is in the nozzle, which disappears once the air leaves the nozzle. In the invention, the air that lies towards the outside of the jet is sucked inwards by a force that is still present even after the jet has left the nozzle, and in fact is still present when the jet is in the atmosphere, some distance downstream of the nozzle. It is emphasized that the invention provides a means for curbing the jet from spreading that is still present even when the jet has left the nozzle.

DETAILED DESCRIPTION OF PREFERRED EMBODIMENTS

By way of further explanation of the invention, exemplary embodiments of the invention will now be described with reference to the accompanying drawings, in which:

FIG. 1 is a diagrammatic representation of a nozzle under test, in which air passing through the nozzle contains smoke, for visibility;

FIG. 2 corresponds to FIG. 1, and shows a prior art nozzle that incorporates the invention;

FIG. 10 is a layout of several nozzles;

FIG. 11*a* is a side view of a plenum, for supplying air to several nozzles;

FIG. 11*b* is an end view of the plenum of FIG. 11*a;*

FIG. 12*a* is a side view of another plenum;

FIGS. 12*b* and 12*c* are front and top views of the plenum of FIG. 12*a*.

The apparatuses shown in the accompanying drawings and described below are examples which embody the invention. It should be noted that the scope of the invention is defined by the accompanying claims, and not necessarily by specific features of exemplary embodiments.

Figure 2:
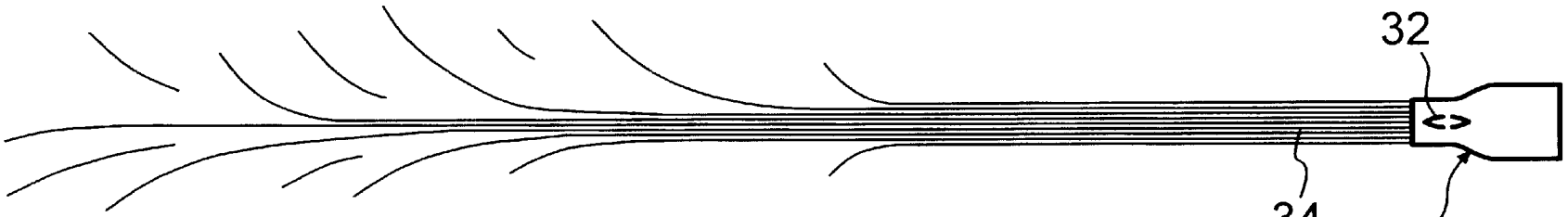
Figure 1:
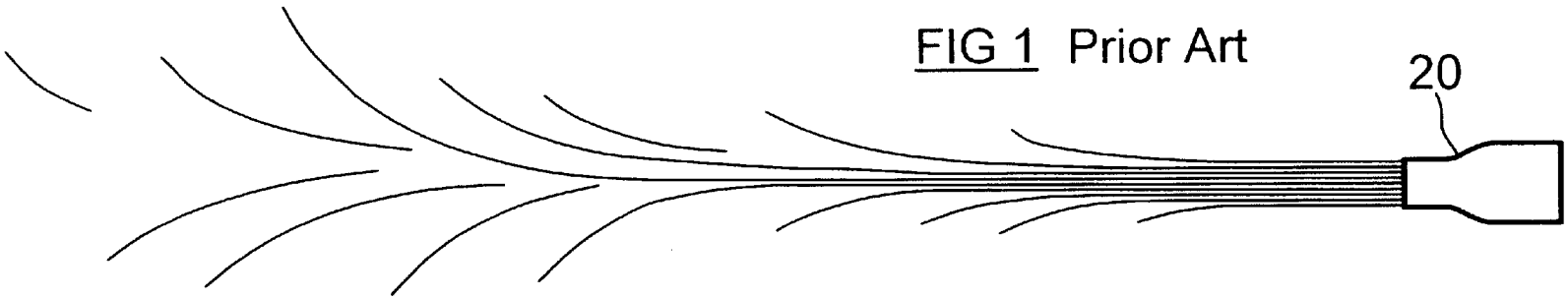
FIG 1 Prior Art

FIGS. 1 and 2 illustrate the difference between a conventional air-blow nozzle unit 20 (FIG. 1) and a nozzle unit 23 that incorporates an internal faired bullet, in accordance with the invention (FIG. 2). In both cases the mouth of the nozzle unit is about 2.25" in diameter and the nozzle unit is supplied from a pipe of about 4" diameter. The difference in the length of forceful penetration of the jets arises because of the presence of the bullet 32 in the nozzle of FIG. 2.

Figure 3:
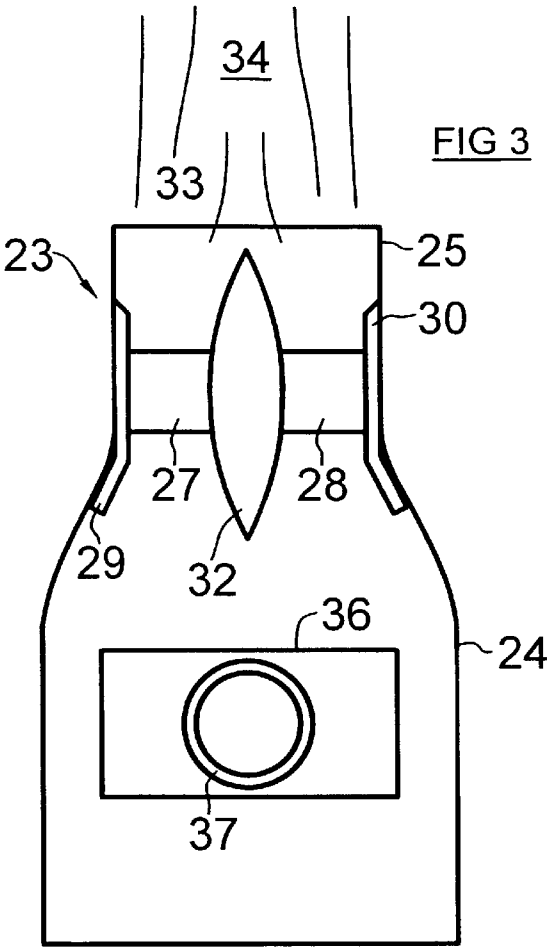
FIG. 3 is a cross-section of the nozzle of FIG. 2.
Figure 4:
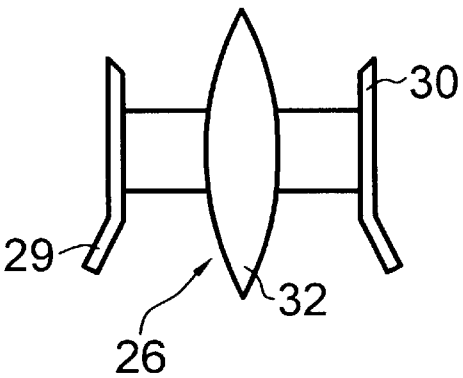
FIG. 4 is a front elevation of a component of the nozzle of FIG. 2.

FIGS. 3 and 4 are cross-sections of the nozzle unit 23 of FIG. 2. The housing 24 is shaped to converge to a right-cylindrical nose 25. The housing 24 is formed from a single piece of (aluminum) sheet metal, by spinning the sheet into a tubular form.

Figure 5:
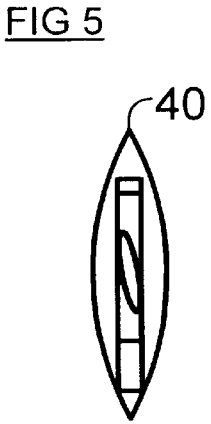
FIG. 5 is a side elevation of the component of FIG. 4.
Figure 6:
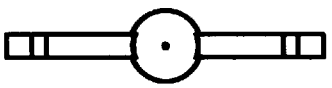
FIG. 6 is a pictorial view of the component of FIG. 4.

The bullet unit 26 shown in FIGS. 4,5,6 fits concentrically inside the nose 25, and includes two radial arms 27,28. The arms terminate with bars 29,30. The bullet unit, comprising the bullet 32, the arms 27,28, and the bars 29,30, are formed as a one-piece aluminum casting. The bullet unit is mounted in place in the nose 25 by welding the bars 29,30 to the internal cylindrical wall of the nose 25.

The bullet 32 is of an aerodynamically faired configuration, the shape being so designed as to impart a minimum tendency to cause drag and turbulence in the air flow passing through the nozzle. The designer should take care to cause as little energy as possible to be dissipated in the nozzle; any energy that is dissipated as turbulence in the nozzle takes away from the energy that would otherwise be available for projecting the jet of air toward the work-piece. The designer's aim is to create a reduced-pressure region downstream of the bullet, without creating turbulence.

The radial arms 27,28 are faired also, to minimise any tendency of the arms to create turbulence. However, as shown in FIG. 5, the arm 27 is angled in the FIG. 5 view. Thus, air passing the arm 27 is given a velocity to the left. The arm 28 is similarly angled, and deflects its stream of air to the right. Thus, the air emerging from the nose 25 has a degree of imparted helical twist or spin. Again, the designer should take care, when imparting the spin to the air flow, not to induce turbulence.

In the type of system as illustrated, air is blasted from the mouth 33 of the nozzle with a great deal of vigour. Air-flows in the region of 400 CFM are typical. It is the intention that the blast of air should be able to perform useful work four, five, or even six, feet away from the 2¼ inch nozzle.

The presence of the bullet 32 means that the air jet flowing from the nozzle contains a reduced-pressure region 34, downstream of the bullet. (Of course, no such reduced-pressure region is present in a conventional nozzle, which has no bullet). This reduced-pressure region gives rise to a suction force tending to draw or hold the jet of air together. The reduced-pressure region 34 tends to focus the jet, stopping the jet from expanding or spreading. It is recognised that the more the jet can be prevented from spreading, the further the jet can be made to penetrate.

A jet of fast-moving air, as it emerges into, and interacts with, the ambient air, starts to slow down. The outer portions of the jet are retarded first. The molecules of air in the outer portion start to spread out and become dissipated. In other words the molecules of the outer portion start to acquire an outwards or radial component to their velocity. Gradually, as the jet travels further from the nozzle, the whole air stream spreads and becomes dissipated.

The reduced-pressure region 34 provides a force acting on the jet, which tends to inhibit the jet from spreading laterally. Thus, because of the reduced-pressure region, the tendency of the outer portions of the jet to acquire an outward velocity is resisted. The air stream is held together by the reduced-pressure region. Thus the stream remains in focus for a significantly longer distance downstream from the nozzle, and the depth of penetration at which the blast of the air stream can do useful work is thereby increased.

The helical twist imparted to the stream by the angled arms 27,28, tends to make the stream a little more coherent, and can also be significant in increasing the depth of penetration of the air stream.

Figure 7:
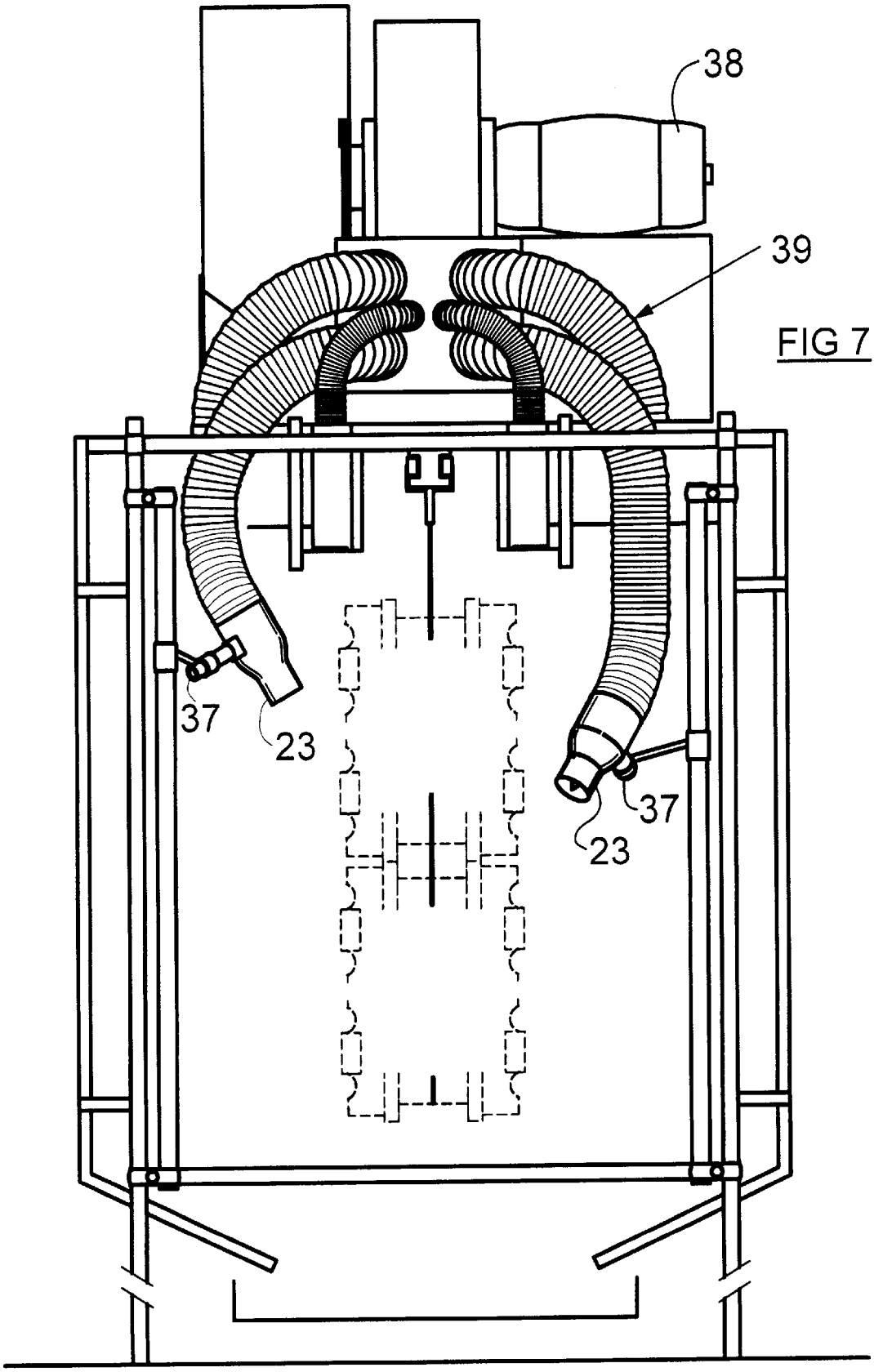
FIG. 7 is a pictorial view of the nozzle of FIG. 2, in use.

The nozzle unit 23 is provided with a mounting fixture 36, which comprises a short stub-tube 37 welded to the outside of the housing 24. In a typical installation, several of the nozzle units are provided (FIG. 7), and directed around the work-piece. The mounting fixture provides that each nozzle unit is adjustable as to the angle at which its jet is directed, and the unit is locked in place by clamping the stub-tube 37 to a fixed frame.

As mentioned, a typical air flow through a 2¼-inch nozzle would be around 400 CFM. Such a flow would be supplied in the supply pipe 39 at a pressure of about 1½ psi. An electric motor 38 is provided to power the fan to supply air at the required energy level.

The dimensions of the bullet are important. It might be considered that the bullet should have a large cross-sectional area in relation to the nozzle diameter, in order that the reduced-pressure region 34 downstream of the bullet might be as marked as possible. It might be considered that, the lower the pressure in the region 34, the more marked the effect the reduced-pressure region has in preventing the jet from spreading and holding the jet together. However, there is a limit to the pressure reduction that can be achieved in the region 34. If the diameter of the bullet were too large, the air flow would be disrupted downstream of the bullet, and turbulence would result, with consequent loss of energy. For a nozzle having a nominal diameter of 2¼ inches, the bullet preferably should be no more than about 1¼ inches in diameter.

On the other hand, the bullet should not be too small, or the effect of the bullet in creating a low-pressure region downstream of the nozzle will be negligible. Thus, the bullet should have a diameter of at least ¾ inches.

Of course, the invention is not limited to just one size of nozzle. The following table sets out some of the parameters present in some different sizes of nozzles.

| | | | | | |
|---|---|---|---|---|---|
| Nominal nozzle diameter | 4" | 2¼" | 2¼" | 1" | 1" |
| Bullet Diameter | 2" | 1¼" | ¾" | ½" | ⅜" |

-continued

| | | | | | |
|---|---|---|---|---|---|
| Axial length of bullet | 5" | 3⅛" | 3" | 2" | 1½" |
| Supply pipe diameter | 6" | 4" | 4" | 2" | 2" |
| Air pressure in supply pipe, psi | ¾ | 1½ | 1½ | 1½ | 1½ |
| Air flow in supply pipe, CFM | 850 | 400 | 400 | 100 | 100 |
| Number of inches after leaving the nozzle before air velocity falls below 10,000 ft/min | 60" | 36" | 30" | 24" | 20" |
| Overall Length of nozzle unit, including hose-fixing spigot | 10" | 7⅛" | 7⅛" | 5" | 5" |

(These parameters should be regarded as typical and average, not as performance guarantees.)

The performance of the unit is measured by the amount of horsepower required from the motor driving the fan, in order to create the number of inches of penetration of the high-velocity jet, as indicated in the table.

To minimize the aerodynamic drag caused by the bullet, the downstream end of the bullet preferably should be conically tapered to a point 40.

In some applications, for example in automotive spray painting, it can be advantageous to apply a highlighting liquid to the surface of the workpiece prior to painting. The liquid highlights any surface defects, if present, whereupon the workpiece can be removed from the production line for remediation before paint is applied. In an alternative construction (not shown), the bullet is provided with a tube running down the centre of the bullet, and the highlighting liquid can be applied to the surface of the components by introducing the liquid through the tube, whereby the liquid emerges at the point 40, and is carried with the jet of air to the workpiece.

The location at which the bullet terminates is important. If the bullet were to terminate upstream of the mouth 33 of the nozzle, the flow of air will start to conform to the nozzle, rather than to the bullet, and the effect of the bullet might be lost. On the other hand, if the bullet were to protrude too far downstream of the mouth, the stream might tend to diverge upon emerging from the nozzle, because of the presence of the protruding bullet, and the beneficial effect of the low-pressure area would be lost.

The nozzle itself should be kept short, for mechanical convenience. Typically, the designer will make the length L of the nose (i.e the length of the right-cylindrical nose of the nozzle, about equal to the diameter of the nozzle. The flexible hose that conveys the air supply to the nozzle is clamped to a hose spigot of the nozzle unit, and the nozzle unit includes a transition portion, which smoothly converges the airflow inwards, into the cylindrical nozzle. The transition portion has an axial length also about equal to the diameter of the nozzle.

The reduced diameter nose 25 of the nozzle is where the velocity of the air is at its highest, and therefore also were the friction is at its highest. (The friction losses of an air stream in a tube are proportional to the cube of the velocity.) Not only does the friction give rise to direct loss of energy but the friction also causes differential velocities within the jet, in that the radially-outermost portions of the jet are retarded by the friction, and so travel more slowly than the main area of the jet. On the other hand, this tendency to differential velocity, due to friction of the outer regions of the jet against the walls of the nozzle, is offset by the fact that the bullet creates some similar retardation of the centre part of the jet. Both the nozzle and the bullet should be kept short, to minimize aerodynamic friction losses.

The nozzle is most effective when the nose 25 of the nozzle is right-cylindrical. If the nose were convergent, emergence of the jet into the open air would be too abrupt and turbulence might result. If the nose were divergent, part of the energy of the jet would be lost creating back-pressure against the nozzle. A right-cylindrical nozzle enables a minimum energy loss of the jet in emerging from the nozzle. The nozzle should be right-cylindrical right to the mouth of the nozzle.

Figure 8:
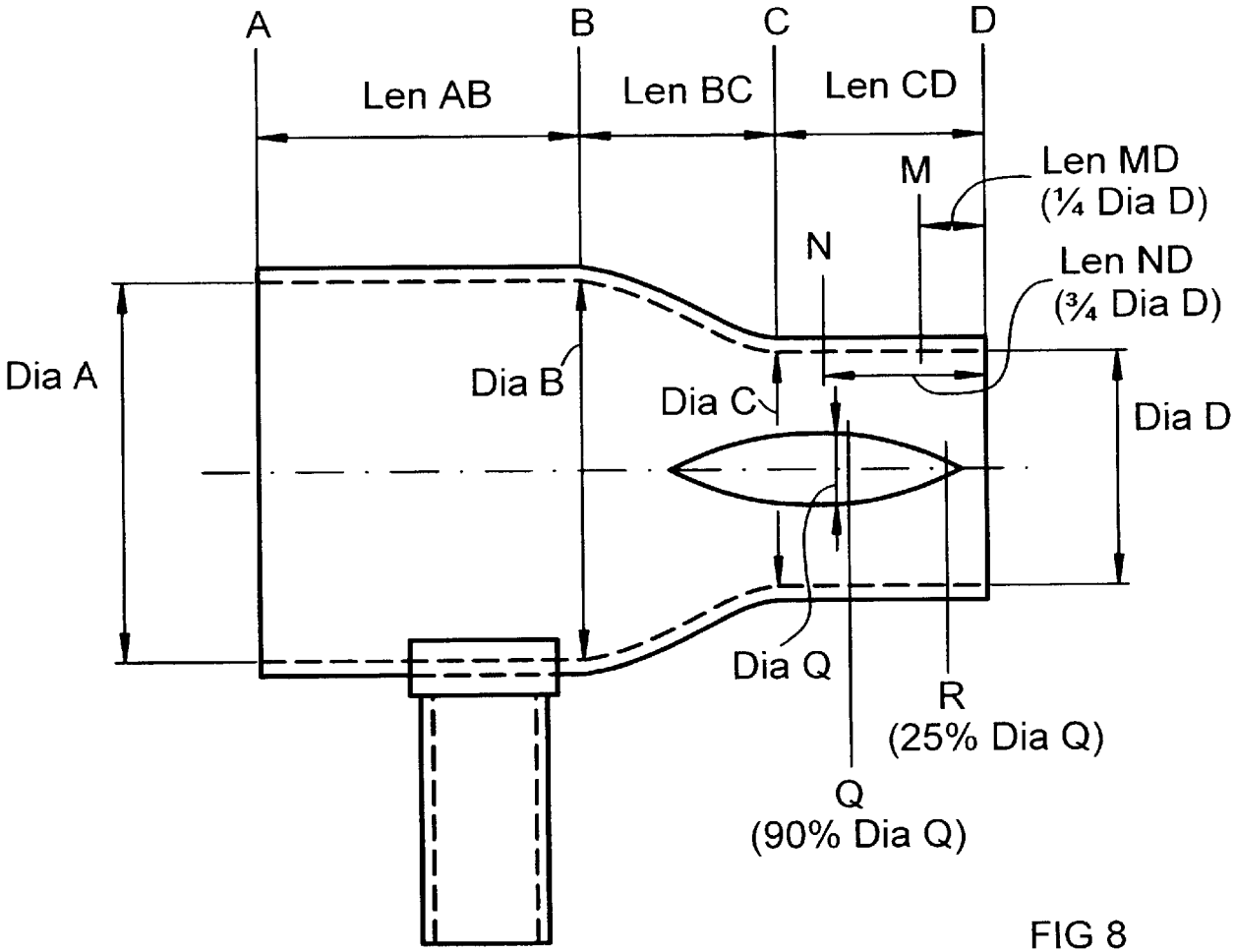
FIG. 8 shows a nozzle unit, and illustrates some dimensional terminology.

FIG. 8 shows how the dimensions of the nozzle should be related to each other, for good results.

Axial locations A,B,C,D are present along the axial length of the nozzle unit, in order from upstream to downstream, the axial location D lying at the mouth of the nozzle unit, respective diameters at the axial locations, designated DiaA, DiaB, DiaC, DiaD, being associated therewith.

Between axial locations A and D, the nozzle unit has an inward-facing surface, which is smooth and substantially without any sudden change in diameter.

An air-entry portion of the nozzle unit lies between axial locations A and B, in which the diameter of the nozzle unit is not less than DiaB. The axial distance LenAB between axial locations A and B is more than 50% of DiaB. In the cases depicted herein, the diameter DiaB obtains not only over the air-entry portion, but also the air supply pipe has a diameter more or less the same as DiaB. (It may be noted that where the diameter is the same, the airflow velocity is the same, so the air in the air-entry portion is still moving at the same speed as the air in the pipe.)

A convergence-transition portion of the nozzle unit lies between axial locations B and C. DiaC is smaller than about 75% of DiaB. Preferably, the cross-sectional area at axial location C, and of the nose portion downstream of C, is less than about 50 percent of the cross-sectional area of the air-entry portion. The convergence-transition portion has walls that define a smoothly convergent air-flow-transition between DiaB and DiaC.

Preferably, the convergence-transition portion is short, in that the axial distance LenBC between axial locations B and C is less than twice DiaB, and (more preferably) is less than DiaB.

The nose portion of the nozzle unit lies between axial locations C and D. The nose portion should be roughly "square" in the FIG. 8 view, in that the axial distance LenCD between axial locations C and D differs from DiaD by less than 50% of DiaD, and preferably by less than 25% of DiaD. The nose portion is right-cylindrical, to the extent that DiaD differs from DiaC by less than 10%.

Axial locations Q,R are present along the axial length of the bullet, in order from upstream to downstream. DiaQ is the maximum overall diameter of the bullet downstream of axial location C, and the axial location Q is the downstream extremity at which the diameter of the bullet is more than 90% of DiaQ. DiaR is the diameter of the bullet at axial location R, DiaR being 25% of DiaQ.

Axial location R on the bullet lies downstream of axial location M on the nozzle unit, axial location M being a distance LenMD upstream of axial location D, LenMD being 25% of DiaD. Axial location Q on the bullet lies downstream of axial location N on the nozzle unit, axial location N being a distance LenND upstream of axial location D, LenND being 75% of DiaD.

If the bullet were located further upstream than is specified by these dimensions, the effects of the bullet in creating a low pressure region downstream of the nozzle would be largely lost. It is the combination of the reduced diameter cylindrical nose, and the fact that the bullet is placed actually within the cylindrical nose, that enables the very marked downstream focussing effect.

Preferably, the maximum overall cross-sectional area of the bullet downstream of axial location C is not less than about 10 percent, and more preferably is about 25%, of the cross-sectional area of the mouth of the nozzle unit, at axial location D.

(In this specification, the conduits (nozzles, pipes, etc), and bullets, are depicted as circular (cylindrical) structures. The invention may be applied to other shapes of conduit, however, such as elliptical. In that case, the diameter of an area of the conduit or bullet should be construed as the average of the distances across the cross-sectional area of the conduit or bullet.)

Figure 9:
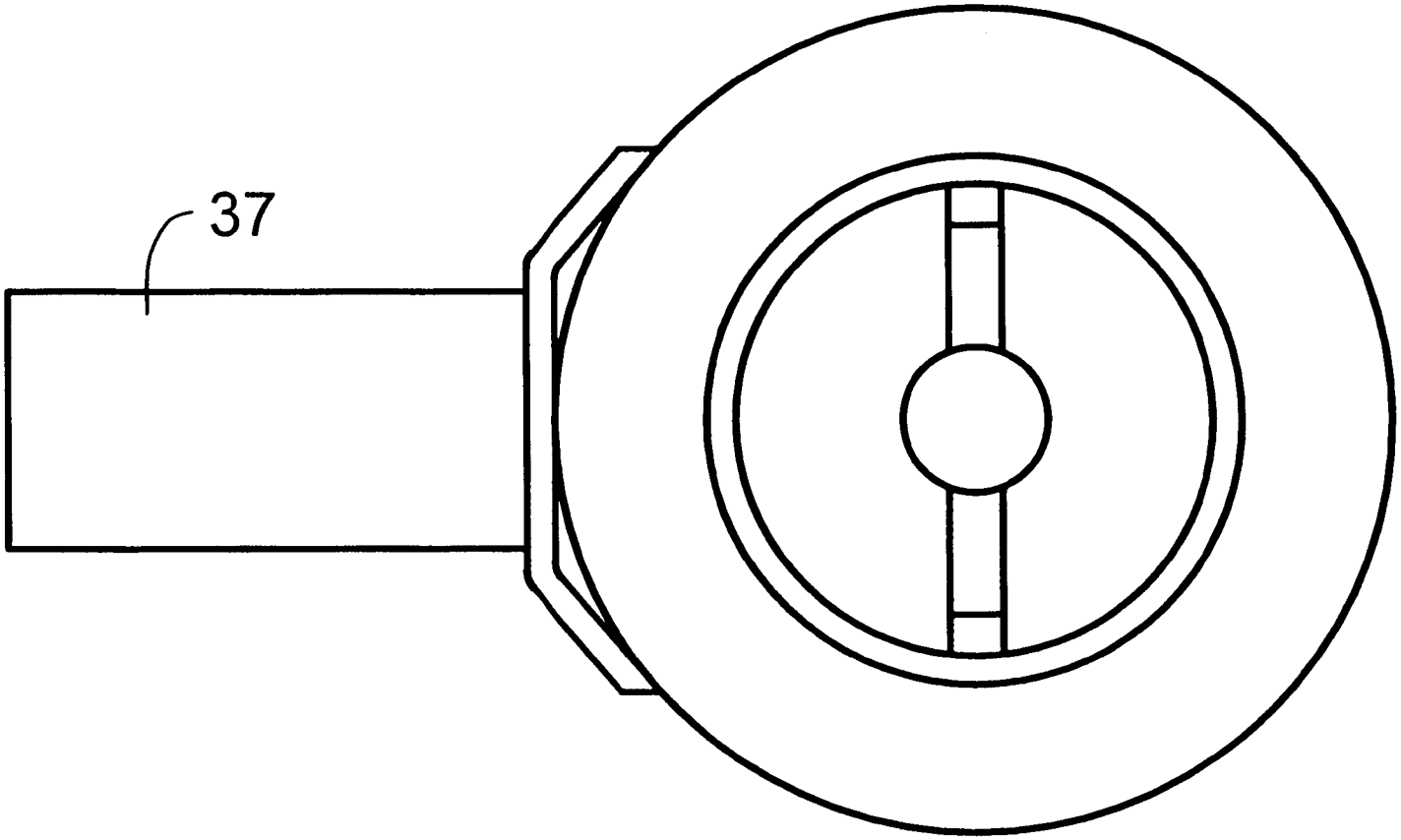
FIG. 9 is an end view of the nozzle unit of FIG. 8.

FIG. 9 shows how the stub-tube 37 of the mounting-fixture 36 is secured to the nozzle unit. By means of the stub-tube, the nozzles can be quickly and conveniently adjusted into position, and firmly secured. FIG. 10 illustrates the versatility arising from the provision of this type of mounting-fixture.

FIGS. 11*a*,11*b*, and FIGS. 12*a*,12*b*,12*c* show different configurations of plenums, whereby pressurised air from the fan(s) can be collected, and fed (via flexible pipes) to the various nozzles. It is noted that a plenum is a comparatively large-volume structure, in which the energy in the pressurised air is in the form of static pressure, rather than velocity. The use of large plenums and pipes enables the velocity of the air to be kept as slow as practical, until the air enters the final nozzle. On the other hand, economy dictates that the plenums and pipes should be small. The plenums as shown, in combination with a convergence-transition portion immediately upstream of the final nose of the nozzle, represents a good compromise between operational efficiency and installation economy. Some of the other optional and preferred features of the invention will now be described.

Preferably, the nozzle is a substantially in-line extension of the air-supply pipe, i.e the air-supply pipe and the nozzle are co-axial. The air-supply pipe includes a flexible hose, and so is capable of being curved or bent; however, sharp bends should be avoided, since they tend to spoil the air flow.

Preferably, the transition portion, the large tubular portion of the unit (which includes the hose-spigot for clamping the flexible hose), and of course the bullet itself, are also all co-axial.

Preferably, the nozzle is of a substantially smaller diameter than the large tubular portion, the cross-sectional area of nozzle being between 25 and 50 percent of the cross-sectional area of large tubular portion.

Apparatuses of the type as described herein may be used for the purpose of drying moisture from work-pieces, for rapid cooling of heated workpieces, for blowing away sand from castings, for cleaning remnants of particulate debris following sand-blasting, and similar operations.

What is claimed is:

1. Apparatus for blowing a jet of air at a workpiece, the apparatus being configured to project the jet a long distance of penetration, wherein:

the apparatus includes a means for supplying pressurised air at a pressure not more than 2 psi;

the apparatus includes a nozzle unit;

the apparatus includes an air-supply pipe, for supplying the pressurised air to the nozzle unit;

the nozzle unit has a mouth, which is open to the atmosphere, and which is so configured that the jet of air emerges therefrom into the atmosphere at a high velocity;

the nozzle unit is so configured, in relation to the air-supply pipe, that air passing through the nozzle unit is caused to undergo a substantial increase in velocity;

walls of the nozzle unit are defined by the following parameters:

(a) axial locations A,B,C,D are present along the axial length of the nozzle unit, in order from upstream to downstream, the axial location D lying at the mouth of the nozzle unit;

(b) the nozzle unit has respective diameters at the axial locations, designated DiaA, DiaB, DiaC, DiaD;

(c) between axial locations A and D, the nozzle unit has an inward-facing surface, which is smooth and substantially without any sudden change in diameter;

(d) an air-entry portion of the nozzle unit lies between axial locations A and B; and (i) between axial locations A and B, the diameter of the nozzle unit is not less than DiaB;

(ii) the axial distance LenAB between axial locations A and B is more than 50% of DiaB;

(e) a convergence-transition portion of the nozzle unit lies between axial locations B and C; and (i) DiaC is smaller than about 75% of DiaB; and (ii) the convergence-transition portion has walls that define a smoothly convergent air-flow-transition between DiaB and DiaC;

(f) a nose portion of the nozzle unit lies between axial locations C and D; and (i) the axial distance LenCD between axial locations C and D differs from DiaD by less than 50% of DiaD; and (ii) the nose portion is right-cylindrical, to the extent that DiaD differs from DiaC by less than 10%;

the apparatus includes a bullet, and a bullet-mounting-means, which is effective to mount the bullet in the nozzle unit, in close adjacency to the mouth;

the size of the bullet in relation to the nozzle unit, and the disposition of the bullet as mounted in the nozzle, are such as to create, aerodynamically, a reduced-pressure-region inside the jet of air emerging from the nozzle, downstream of the mouth, and to create, in the said reduced-pressure-region, a pressure reduction of such magnitude as to give rise to a substantial force acting upon the jet from the inside thereof, being a force tending to inhibit the jet from spreading outwards;

the bullet is aerodynamically faired, to the extent that the bullet is thereby effective to aerodynamically create the reduced-pressure-region inside the jet with minimum turbulence and drag;

the bullet is defined by the following parameters:

(a) axial locations Q,R are present along the axial length of the bullet, in order from upstream to downstream;

(b) the bullet has an outer surface which is smooth, aerodynamically-faired, and substantially without any sudden change in diameter;

(c) DiaQ is the maximum overall diameter of the bullet downstream of axial location C, and the axial location Q is the downstream extremity at which the diameter of the bullet is 50 more than 90% of DiaQ;

(d) DiaR is the diameter of the bullet at axial location R, DiaR being 25% of DiaQ;

(e) axial location R on the bullet lies downstream of an axial location M on the nozzle unit, axial location M being a distance LenMD upstream of axial location D, LenMD being 25% of DiaD;

(f) axial location Q on the bullet lies downstream of an axial location N on the nozzle unit, axial location N being a distance LenND upstream of axial location D, LenND being 75% of DiaD.

2. As in claim 1, wherein the maximum overall cross-sectional area of the bullet downstream of axial location C is not less than about 10 percent of the cross-sectional area of the mouth of the nozzle unit, at axial location D.

3. As in claim 2, wherein the maximum overall cross-sectional area of the bullet downstream of axial location C is about 25 percent of the cross-sectional area of the mouth of the nozzle unit, at axial location D.

4. As in claim 1, wherein the axial length of the nose portion, being the axial distance LenCD between axial locations C and D, differs from DiaD by less than 25% of DiaD.

5. As in claim 1, wherein the bullet, on its downstream side, is cone shaped, and converges to a point at its downstream extremity.

6. As in claim 1, wherein the bullet-mounting-means is effective to position the bullet so that the downstream extremity of the bullet is substantially in line axially with the axial location D.

7. As in claim 1, wherein:

the bullet-mounting-means includes at least one radial spoke, and includes a means for attaching same to the inside surface of a wall of the nose portion;

the said at least one spoke being slim enough in cross-sectional area as to occupy only a negligible proportion of the annular cross-sectional area of the nose.

8. As in claim 7, wherein the or each spoke is faired, for minimum drag and turbulence.

9. As in claim 7, wherein the or each spoke is set at such an angle as to create and promote a slight helical swirl to the emerging jet.

10. As in claim 1, wherein the said diameters DiaA, DiaB, DiaC, DiaD, of the nozzle unit are mutually co-axial, and the nozzle unit is a substantially co-axial in-line extension of the air-supply pipe.

11. As in claim 1, wherein the axial distance LenBC between axial locations B and C is less than twice DiaB.

12. As in claim 1, wherein the convergence-transition portion is short, in that the axial distance LenBC between axial locations B and C is less than DiaB.

13. As in claim 1, wherein the nose portion is of a substantially smaller diameter than the air-entry portion, the cross-sectional area of nose being between 25 and 50 percent of the cross-sectional area of the air-entry portion.

14. As in claim 1, wherein:

the nozzle unit includes the right-cylindrical nose portion, the convergence-transition portion, the air-entry portion, and a tubular hose spigot portion around which a flexible hose can be secured;

as to its form, the said nozzle unit is generally a uni-axial, multi-diameter tube, which comprises a single tubular piece of metal.

15. As in claim 14, wherein:

the apparatus includes a mounting fixture, which is structurally suitable for mounting the nozzle unit to a frame;

the mounting-fixture includes means whereby the attitude and orientation of the nozzle, and its position relative to the frame, can be adjusted.

16. As in claim 1, wherein the means for supplying pressurised air includes a fan, having an air flow rate of at least 300 cfm.

17. As in claim 16, wherein the means for supplying pressurised air includes an electric motor, and the fan is driven by the electric motor.

18. Apparatus for cleaning or drying a workpiece by blowing air at the workpiece, wherein:

the apparatus includes the apparatus of claim 15, and includes a plurality of the nozzle units as defined therein;

the apparatus includes a frame and means for mounting the plurality of nozzle units in the frame;

the apparatus includes a fan, and an electric motor for driving same, and includes a plenum for receiving pressurised air from the fan and for distributing the pressurised air to the nozzle units;

and the nozzle units lie in the frame each at such an orientation as to axial location at the workpiece, and to blow air over the workpiece.

* * * * *